US005134657A

United States Patent [19]

Winholtz

[11] Patent Number: 5,134,657

[45] Date of Patent: Jul. 28, 1992

[54] VOCAL DEMODULATOR

[76] Inventor: William S. Winholtz, 11859 St. Paul Cir., Thornton, Colo. 80233

[21] Appl. No.: 552,014

[22] Filed: Jul. 13, 1990

Related U.S. Application Data

[63] Continuation-in-part of Ser. No. 322,674 Mar. 13, 1989, abandoned

[51] Int. Cl.[5] ..... G10L 5/00

[52] U.S. Cl. ..... 381/41

[58] Field of Search ..... 381/41–47

[56] References Cited

U.S. PATENT DOCUMENTS 3,855,416 12/1974 Fuller ..... 381/41

3,978,287 8/1976 Fletcher ..... 381/41

*Primary Examiner*—Emanuel S. Kemeny

[57] ABSTRACT

Speech analysis apparatus for detection and measurement of low frequency amplitude and frequency modulations, tremor, of the fundamental frequency. A microphone signal of sustained phonation is input to the apparatus which demodulates and measures five parameters digitally displayed; fundamental frequency, amplitude demodulated frequency, amplitude demodulated level, frequency demodulated frequency, and frequency demodulated level. Demodulated outputs are provided for external analysis. A variable cutoff low pass filter maintains cutoff at 1.5 times the fundamental input frequency.

5 Claims, 1 Drawing Sheet

VOCAL DEMODULATOR

This application is a continuation-in-part of pending prior application Ser. No. 322,674 filed on Mar. 13, 1989, abandoned, of William S. Winholtz for Vocal Demodulator.

BACKGROUND OF THE INVENTION

The invention relates to a speech analysis apparatus for measuring and analyzing vocal tremor. Sustained phonation from a subject contains information in a composite form of vocal stability. Sustained phonation can be demolated into low frequency amplitude and frequency modulation components of the fundamental frequency. These components which make up vocal tremor occur in the range of 1 to 25 Hz. In demolation of sustained phonation the relationship between fundamental (carrier) frequency and modulation frequency is important. The factor of separation must be large enough to give proper definition to the modulating signal. As the separation factor decreases demodulation level will decrease, even though the modulation level has not changed, thus yielding a demodulation level that is erroneous. Demodulation of frequencies near the carrier frequency are useful for cycle to cycle, jitter and shimmer analysis, however they are not useful for tremor analysis. Once the fundamental frequency has been accurately demodulated the levels of modulation serve a useful purpose. Low levels of modulation are associated with normal phonation, while high levels of modulation are associated with pathological phonation. Different ranges of demodulated frequencies are associated with different physiological sources. Therefore, it is usefull to measure the level and frequency of these components. Different combinations of amplitude and frequency modulation frequency and level could be used to isolate different sources of modulation in the vocal tract. For instance, the primary source for amplitude modulation is subglottal air pressure, for frequency modulation neromuscular control of the cricothyroid muscle. Simultaneious display of these parameters; amplitude modulation frequency, amplitude modulation level, frequency modulation frequency, and frequency modulation level are useful to indicate a change in tremor which can occur in one, or a combination of parameters. Vocal tremor may be an early symptom or only symptom of a neurologic disease. The frequency and level of vocal tremor may differ among diseases of different neural subsystems. Therefore, analysis of vocal tremor with the invention may be used to make important contributions to early and differential diagnosis of neurological diseases and consequently to treatment decisions.

Earlier devices have used demodulation of vocal signals in the amplitude or frequency domain for other applications. One device produces frequency demodulation up to cycle to cycle frequencies of the fundamental frequency. A microphone signal is preconditioned with various user selected preset filters. After filtering, the signal is converted to a square wave of the same period as the fundamental frequency. This square wave drives a frequency counter, indicating fundamental frequency, and frequency to voltage converter which provides an arbitrary frequency demodulation. This signal is used to drive the vertical input to an oscilliscope display.

Another device produces amplitude demodulation and utterance decay on connected speech for use in suicidal predisposition analysis. A microphone signal of several utterances is converted to a digital format and signal components below 200 Hz and above 10,000 Hz are removed. The signal is further conditioned and produces a waveform which depicts onset and offset, as well as amplitude modulation of the utterances. By determining high or low levels of amplitude modulation and rate of decay of the utterances, a subject is analyzed for suicidal predisposition.

Although other methods of demodulation have been presented, none provide means for conditioning the input signal and subsequent analysis of the fundamental frequency signal as presented here. It is an object of the invention to provide a calibrated real time device for accurate level and frequency measurement of amplitude and frequency modulation components in sustained phonation. These measures of stability can assist in diagnosis of nerological diseases, and quantify the effects of pre and post thearapy, surgery, or medication. Another object of the invention is to provide amplitude and frequency demodulated outputs allowing external analysis of vocal tremor components.

SUMMARY OF THE INVENTION

A microphone signal of sustained phonation is a complex signal. It consists of the fundamental frequency, and frequencies called harmonics and formants produced by the filtering effects of the vocal tract on the fundamental frequency. Harmonics in the vocal tract are integer multiples of the fundamental frequency and vary with fundamental frequency. Formants are fixed resonances in the vocal tract. Both harmonics and formants are dependent on the physical characteristics of the tract. Higher in frequency than the fundamental frequency, these components produce their own modulations different from fundamental frequency modulations. Demodulation of unfiltered phonation will contain a mix of modulation components from the entire vocal tract resulting in demodulation which is subject dependant. These effects can be reduced by a variable low pass filter set above the fundamental frequency. After filtering, the fundamental frequency is preserved along with its amplitude and frequency modulations.

The invention contemplates a voice tremor analysis apparatus with variable low pass filtering, automatic level control, and other circuitry means for amplitude and frequency demodulation of the fundamental frequency signal. After initial conditioning, envelope peak detection means are used to provide amplitude demodulation, and frequency to voltage conversion means are used to provide frequency demodulation of the fundamental frequency signal. The amplitude and frequency outputs of the demodulators are fed to low pass filters limiting demodulation response. After filtering, these demodulated signals are output to provide means for input to external analysis equipment. One type of analysis is simultaneious display on an oscilloscope of the amplitude and frequency demodulated signals for waveform comparison. Another type of analysis is a Fast Fourier Transform of the demodulated outputs for display of individual frequency distribution. The invention provides means for measurement and digital display of five parameters, fundamental frequency, levels of amplitude and frequency modulation in percent of the fundamental frequency, and frequency of amplitude and frequency modulation.

DESCRIPTION OF THE PREFERRED EMBODIMENTS

Figure 1:
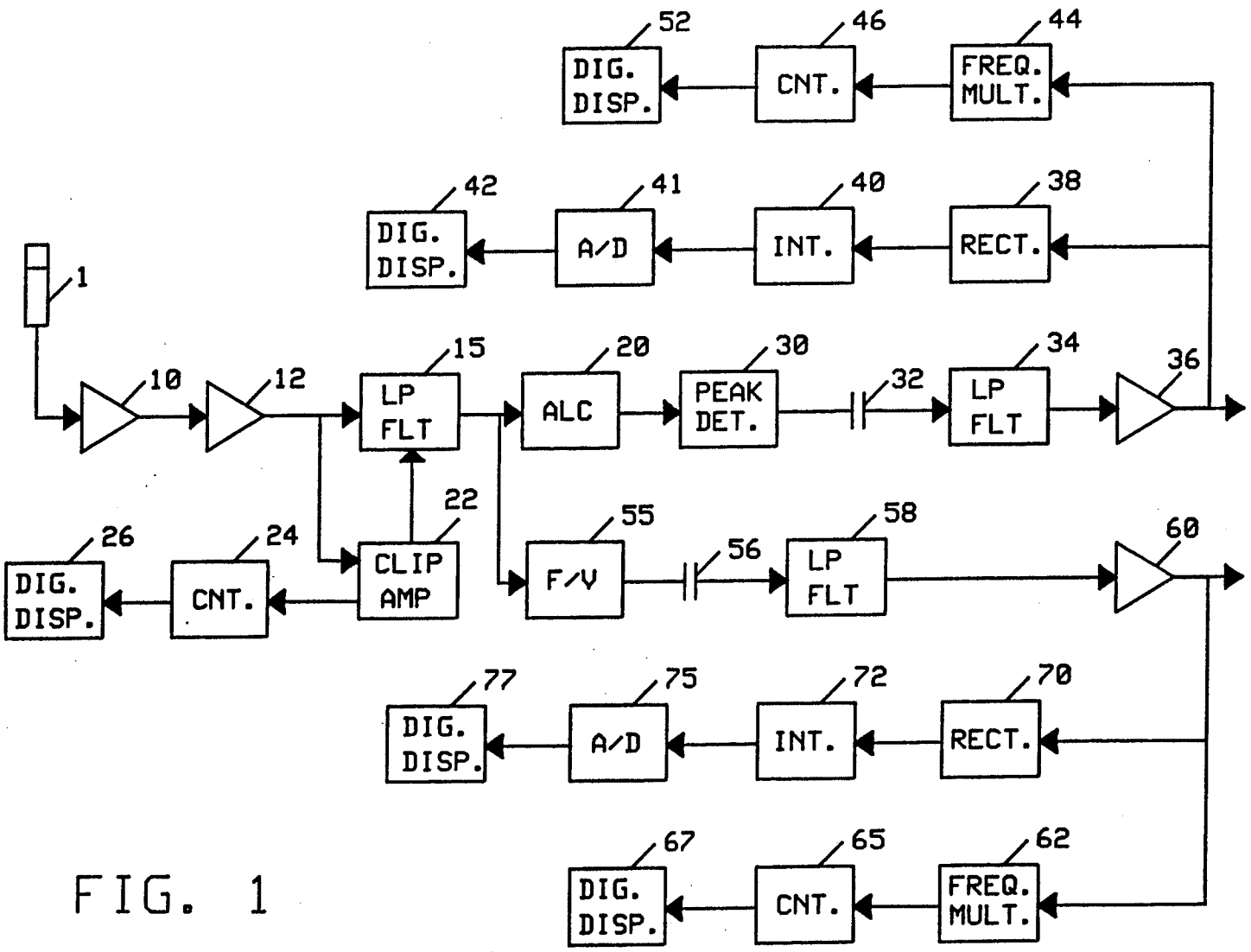

FIG. 1 is block circuit diagram of the speech analysis apparatus.

Refering to FIG. 1, an input signal of sustained phonation to be analyzed is converted with transducer 1, which produces an electric signal from phonation. This signal is amplified by 10, and further amplified by 12. The output of 12 feeds low pass filter 15 and amplifier 22, a high gain amplifier which clips the input signal and produces a square wave of the same period as the fundamental frequency. This square wave is used to drive two other circuits. In the first circuit, it is used to control variable low pass filter 15 to a cutoff frequency 1.5 times the fundamental frequency. This reduces upper harmonic and format energy and passes the fundamental frequency signal. Since harmonic and format energy are dependent on the physical characteristics of the vocal tract, they will very from subject to subject. The use of a variable low pass filter set according to the individual subject allows more accurate processing of the fundamental frequency by the circuitry that follows. In the second circuit, it feeds a counter 24 which drives a digital display 26 indicating frequency of the fundamental frequency. The output of 15 feeds two circuits. In the first circuit, it is input to 20 an automatic level control described later. In the second circuit, it feeds a frequency to voltage converter 55 which produces a voltage that is proportional to input frequency and provides frequency demodulation of the fundamental frequency signal. The output of 55 is capacitively coupled by 56, which removes the DC component, to low pass filter 58 which has a cutoff frequency of 25 Hz and limits the demodulation response. Limiting the responses ensures separation of demodulation from fundamental frequency which is needed for accurate measurement of modulation level. After filtering, the signal is fed to isolation amplifier 60 and feeds level and frequency measurement circuits, as well as provide the frequency demodulated output.

Amplitude of fundamental frequency varies from subject to subject and can vary within a subjects phonation. To provide uniform measurement of amplitude modulation level from subject to subject, the fundamental frequency is input to 20, an automatic level control which produces a constant average level of fundamental frequency. The time constant for automatic level control to take action is made long enough to prevent action of the amplitude modulation signal. The output of 20 feeds peak detector 30 providing envelope amplitude demodulation of the fundamental frequency. After detection the signal is capacitively coupled by 32, which removes the DC component, to low pass filter 34 with a cutoff frequency of 25 Hz limiting the demodulation response. After filtering the signal feeds isolation amplifier 36 which feeds the level and frequency measurement circuits described later, and provides the amplitude demodulated output.

The level and frequency measurement circuits are identical for both of the demodulated outputs and will be described once. Level measurement of the demodulated signals begins with full wave rectifier 70 (38) which feeds integrator 72 (40) to average the signal before analog to digital conversion by 75 (41). The converter 75 (41) drives digital display 77 (42) which indicates demodulated level in percent of the fundamental frequency. Frequency measurement of the demodulated signals begins with 62 (44) a phase lock loop frequency multiplier circuit which produces a square wave output ten times the frequency of the input signal. The square wave feeds counter 65 (46) which drives digital display 67 (52) indicating demodulated frequency. Multipling the input signal by ten, and compensating the decimal place in the digital display, provides an increase in resolution of frequency measurement without increasing the measurement time interval.

An embodiment of the invention has been described. Various modifications within the spirit of the invention will occur to those skilled in the art and these modifications are intended to be within the scope of the following claims.

I claim:

1. A speech analysis apparatus which comprises: transducer means for converting sustained phonation into electrical signals for conditioning by variable low pass filter means that maintains a constant relationship between cutoff frequency and fundamental frequency which is then input to automatic level control means, and then envelope peak detection means for amplitude demodulation of the conditioned input signal, and frequency to voltage conversion means for frequency demodulation of the conditioned input signal, and low pass filter means for the demodulated signals, and means for detection of fundamental frequency.

2. The apparatus of claim 1 wherein the amplitude and frequency demodulated outputs are full wave rectified, integrated, and used to calibrate modulation level displays to read in percent modulation of the fundamental frequency.

3. The apparatus of claim 1 wherein the frequency counters used to display demodulated frequency are fed by phase lock loop frequency multiplication means which are fed by the demodulated amplitude and frequency output signals.

4. The apparatus of claim 1 wherein real-time simultaneious output means are provided for amplitude and frequency demodulated signals of the conditioned input signal.

5. The apparatus of claim 1 wherein means for real-time display of five measured parameters; fundamental frequency, amplitude demodulated frequency, amplitude demodulated level, frequency demodulated frequency, and frequency demodulated level are simultaneiously displayed in digital form.

* * * * *